US010046185B2

(12) United States Patent
Perez et al.

(10) Patent No.: US 10,046,185 B2
(45) Date of Patent: Aug. 14, 2018

(54) FIRE AND SMOKE COMPOSITIONS AND THE PROCESSES OF MAKING THEM

(71) Applicants: Nicholas A. Perez, Lake Elsinore, CA (US); Henry Modregon, Menifee, CA (US); Leslie M. Perez, Lake Elsinore, CA (US)

(72) Inventors: Nicholas A. Perez, Lake Elsinore, CA (US); Henry Modregon, Menifee, CA (US); Leslie M. Perez, Lake Elsinore, CA (US)

( * ) Notice: Subject to any disclaimer, the term of this patent is extended or adjusted under 35 U.S.C. 154(b) by 0 days.

(21) Appl. No.: 15/627,144

(22) Filed: Jun. 19, 2017

(65) Prior Publication Data

US 2017/0281995 A1 Oct. 5, 2017

Related U.S. Application Data

(62) Division of application No. 15/245,001, filed on Aug. 23, 2016, now Pat. No. 9,717,938, which is a division of application No. 14/799,500, filed on Jul. 14, 2015, now Pat. No. 9,446,271.

(60) Provisional application No. 62/024,318, filed on Jul. 14, 2014.

(51) Int. Cl.

| | |
|---|---|
| ***A62D 1/00*** | (2006.01) |
| ***A62C 2/10*** | (2006.01) |
| ***A62C 3/02*** | (2006.01) |
| ***A62C 5/033*** | (2006.01) |
| ***A62C 2/06*** | (2006.01) |

(52) U.S. Cl.
CPC ..... *A62C 2/06* (2013.01); *A62D 1/005* (2013.01); *A62D 1/0064* (2013.01)

(58) Field of Classification Search
None
See application file for complete search history.

(56) References Cited

U.S. PATENT DOCUMENTS

| | | | | | |
|---|---|---|---|---|---|
| 3,354,084 | A * | 11/1967 | Katzer | A62D 1/0064 | 169/14 |
| RE32,649 | E * | 4/1988 | Brandt | A61F 13/53 | 521/149 |
| 5,190,110 | A * | 3/1993 | von Blucher | A62D 1/005 | 169/46 |
| 5,217,445 | A * | 6/1993 | Young | A61F 13/15203 | 604/378 |
| 5,502,082 | A * | 3/1996 | Unger | B01J 20/24 | 521/141 |
| 5,669,894 | A * | 9/1997 | Goldman | A61L 15/42 | 604/366 |
| 5,849,210 | A * | 12/1998 | Pascente | A62C 99/0045 | 169/45 |
| 6,615,539 | B1 * | 9/2003 | Obonai | A01G 31/001 | 47/62 N |
| 7,225,882 | B2 * | 6/2007 | Miller | A62C 2/10 | 169/45 |
| 7,670,513 | B2 * | 3/2010 | Erdner | A62D 1/00 | 252/2 |

(Continued)

*Primary Examiner* — Joseph D Anthony
(74) *Attorney, Agent, or Firm* — Cionca IP Law P.C.; Marin Cionca

(57) ABSTRACT

A method for fire and smoke prevention, suppression or extinction using a composition having sodium polyacrylate and distilled water, wherein the ratio of sodium polyacrylate to distilled water is about 1 to 200, having the step of placing the composition in the path of the fire or smoke.

5 Claims, 21 Drawing Sheets

(56) References Cited

U.S. PATENT DOCUMENTS

| | | | | |
|---|---|---|---|---|
| 2005/0113775 | A1* | 5/2005 | English | A61F 13/15203<br>604/385.01 |
| 2008/0119586 | A1* | 5/2008 | Byerly | A61F 13/53<br>523/111 |
| 2012/0071609 | A1* | 3/2012 | Savla | C08F 220/06<br>525/329.4 |

* cited by examiner

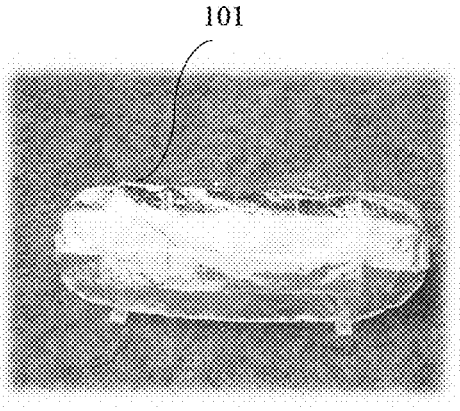
New Generation Fire Shelter
FIG. 1a – Prior Art
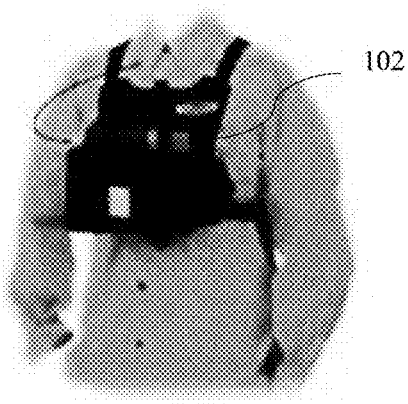
How Fire Shelter is Carried
FIG. 1b – Prior Art
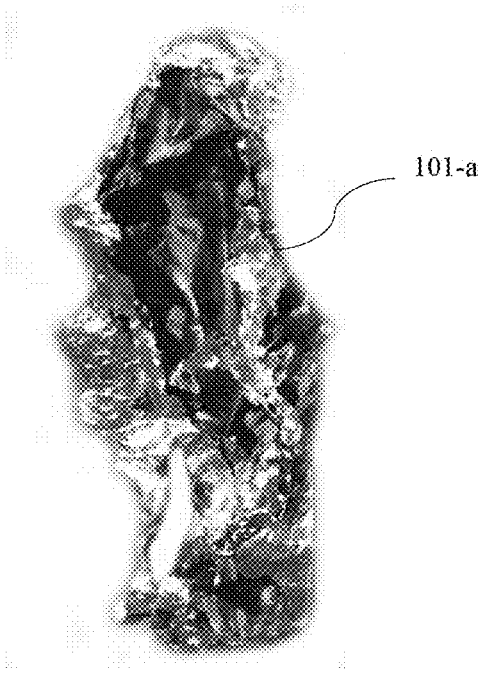
FIG. 1c – Prior Art

TABLE 1

| Tested Mixture | Results | Observations |
|---|---|---|
| Boric Acid Paint (14 oz. of semi-gloss paint and 4 tablespoons of boric acid) | Mixture flared up, and smoke came through | There were holes in the mixture |
| Corn Starch Boric Acid (4 tablespoons of corn starch, 16 oz. of hot water, 1 tablespoon of boric acid) | Mixture didn't burn but did char, smoke came through. | Mixture separated and was watery. Did not adhere to anything. |
| Baking Soda Toothpaste | Mixture scorched then burned, smoke did not penetrate. | Thick enough to hold off smoke. Toothpaste burned and melted. |
| Talc (6 tablespoons of talc and 6 tablespoons of water) | Mixture didn't burn, but fire and smoke did penetrate through. | Mixture separated. Did not adhere to door. |
| Corn Starch Baking Soda (1 tablespoon baking soda, 4 tablespoons corn starch, and 16 oz. hot water) | Mixture scorched and flames came through, smoke came through towards the end. | Once mixture cooled, it became a hard gel. Had air pockets. |
| Corn Starch Detergent (2 tablespoons laundry detergent, 4 tablespoons corn starch, and 16 oz. hot water) | Mixture singed then flames came through, smoke never came through. | Once mixture cooled, it was hard to use. Became hard and stiff. |
| Baking Soda Citric Acid (8 tablespoons baking soda, 2 tablespoons citric acid, and 8 oz. cold water) | Mixture allowed fire and smoke to come through fast. | Mixture flattened with citric acid and became a loose paste. There was no barrier. |
| Beach Sand Paint (4 tablespoons beach sand and 8 oz. semi-gloss paint) | Mixture flared up and allowed fire to pass through, smoke passed through. | Mixture was not flame resistant. Many holes in the mixture. |

FIG. 7

TABLE 1 continued

| | | |
|---|---|---|
| Disclosed composition – gel embodiment | Mixture held back both the fire and smoke. No pass through of fire or smoke occurred within the tested 10 minutes. | Did not run. Consistency was perfect. Filled all the jamb/gap space. Only a slight singe on the side of the fire was observed. |
| Baking Soda Polymer (disclosed composition – gel embodiment and 1 tablespoon of baking soda) | Mixture allowed fire and smoke to pass through fast. | Baking soda broke down the polymer and separated the water. Mixture flattened out, leaving gaps. |
| Boric Acid Polymer (Disclosed composition – gel embodiment and 1 tablespoon of boric acid) | Mixture allowed fire and smoke to pass through fast. | Boric acid broke down the polymer. It made the mixture watery. |

FIG. 7 continued

TABLE 2

| | **Fire (time in seconds)** | **Smoke (time in seconds)** |
|---|---|---|
| Disclosed composition – gel embodiment | 600+ | 600+ |
| Baking Soda Polymer | 76 | 26 |
| Boric Acid Polymer | 82 | 18 |
| Boric Acid Paint | 134 | 26 |
| Corn Starch Boric Acid | 46 | 25 |
| Baking Soda Toothpaste | 198 | 600+ |
| Talc | 52 | 36 |
| Corn Starch Baking Soda | 313 | 468 |
| Baking Soda Citric Acid | 48 | 26 |
| Beach Sand Paint | 78 | 153 |
| Corn Starch Detergent | 138 | 600+ |

FIG. 8

TABLE 3

Convention Oven

Hydrated Polyacrylate vs. Dry Polyacrylate vs. U.S.F Fire Shelter

| | Hydrated Polyacrylate | Dry Polyacrylate | U.S.F Fire Shelter |
|---|---|---|---|
| Minutes | Degrees (Fahrenheit) | Degrees (Fahrenheit) | Degrees (Fahrenheit) |
| 0 min | 67 | 67 | 67 |
| 1 min | 67 | 67 | 118 |
| 2 min | 67 | 69 | 171 |
| 3 min | 67 | 71 | 211 |
| 4 min | 67 | 79 | 243 |
| 5 min | 67 | 93 | 268 |
| 6 min | 67 | 108 | 290 |
| 7 min | 67 | 123 | 309 |
| 8 min | 67 | 136 | 325 |
| 9 min | 67 | 146 | 341 |
| 10 min | 67 | 154 | 353 |
| 11 min | 67 | 162 | 364 |
| 12 min | 67 | 171 | 373 |
| 13 min | 67 | 178 | 383 |
| 14 min | 68 | 185 | 388 |
| 15 min | 68 | 191 | 390 |
| 16 min | 68 | 198 | |
| 17 min | 68 | 203 | |
| 18 min | 69 | 208 | |
| 19 min | 69 | 214 | |
| 20 min | 69 | 216 | |
| 21 min | 69 | 220 | |
| 22 min | 70 | 223 | |
| 23 min | 71 | 226 | |
| 24 min | 71 | 230 | |
| 25 min | 73 | 234 | |
| 26 min | 73 | 237 | |
| 27 min | 74 | 241 | |
| 28 min | 75 | 245 | |
| 29 min | 77 | 249 | |
| 30 min | 78 | 255 | |

FIG. 12a

TABLE 4

Hydrated Polyacrylate

Reflective Shield vs. No Reflective Shield

| | Reflective Shield | No Reflective Shield |
|---|---|---|
| Minutes | Degrees (Fahrenheit) | Degrees (Fahrenheit) |
| 0 min | 67 | 71 |
| 1 min | 67 | 72 |
| 2 min | 67 | 72 |
| 3 min | 67 | 73 |
| 4 min | 67 | 73 |
| 5 min | 67 | 75 |
| 6 min | 67 | 76 |
| 7 min | 67 | 77 |
| 8 min | 67 | 79 |
| 9 min | 67 | 80 |
| 10 min | 67 | 81 |
| 11 min | 67 | 83 |
| 12 min | 67 | 85 |
| 13 min | 67 | 87 |
| 14 min | 68 | 88 |
| 15 min | 68 | 90 |

FIG. 13a

TABLE 4 continued

| | | |
|---|---|---|
| 16 min | 68 | 92 |
| 17 min | 68 | 94 |
| 18 min | 69 | 96 |
| 19 min | 69 | 98 |
| 20 min | 69 | 100 |
| 21 min | 69 | 102 |
| 22 min | 70 | 104 |
| 23 min | 71 | 107 |
| 24 min | 71 | 109 |
| 25 min | 73 | 111 |
| 26 min | 73 | 113 |
| 27 min | 74 | 115 |
| 28 min | 75 | 117 |
| 29 min | 77 | 119 |
| 30 min | 78 | 120 |

1325

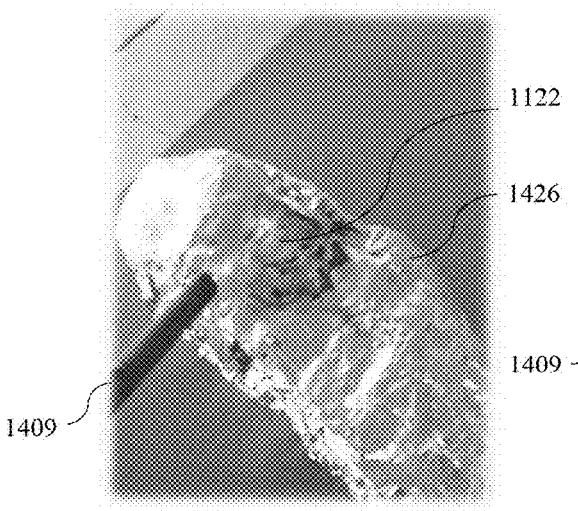
FIG. 14a
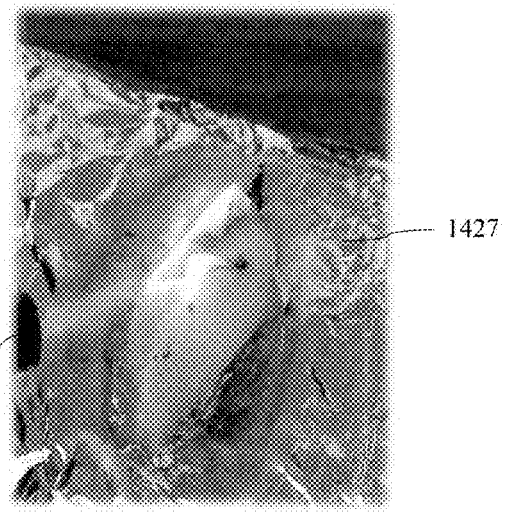
FIG. 14b
TABLE 5
Open Flame Radiation
Hydrated Polyacrylate vs. U.S.F Fire Shelter
| | Hydrated Polyacrylate | U.S.F Fire Shelter |
|---|---|---|
| Minutes | Degrees (Fahrenheit) | Degrees (Fahrenheit) |
| 0 min | 82 | 82 |
| 1 min | 82 | 123 |
| 2 min | 82 | 178 |
| 3 min | 82 | 222 |
| 4 min | 82 | 236 |
| 5 min | 82 | 237 |
| 6 min | 82 | 237 |
| 7 min | 82 | 237 |
| 8 min | 82 | 239 |
| 9 min | 82 | 241 |
| 10 min | 82 | 243 |
| 11 min | 82 | 244 |
| 12 min | 82 | 244 |
| 13 min | 82 | 244 |
| 14 min | 82 | 244 |
| 15 min | 82 | 244 |
FIG. 15a

1528

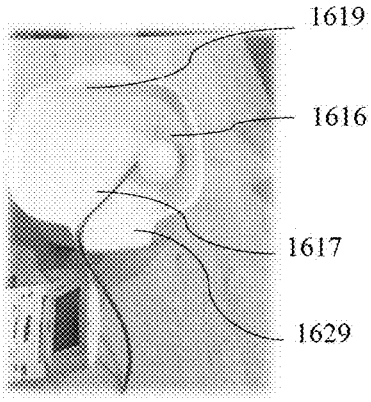
FIG. 16a
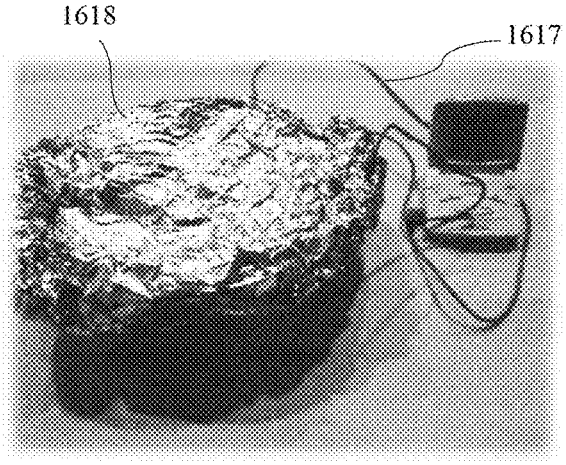
FIG. 16b
TABLE 6
Endothermic Response of Water
Reflective Shield vs. No Reflective Shield
| | Reflective Shield | No Reflective Shield |
|---|---|---|
| Minutes | Degrees (Fahrenheit) | Degrees (Fahrenheit) |
| 0 min | 73 | 73 |
| 1 min | 73 | 74 |
| 2 min | 75 | 80 |
| 3 min | 77 | 87 |
| 4 min | 79 | 95 |
| 5 min | 81 | 106 |
| 6 min | 84 | 116 |
| 7 min | 87 | 122 |
| 8 min | 90 | 131 |
| 9 min | 92 | 139 |
| 10 min | 95 | 148 |
| 11 min | 98 | 156 |
| 12 min | 101 | 165 |
| 13 min | 104 | 172 |
| 14 min | 106 | 180 |
| 15 min | 109 | 188 |
FIG. 17a

TABLE 6 continued

| | | |
|---|---|---|
| 16 min | 112 | 194 |
| 17 min | 115 | 199 |
| 18 min | 118 | 203 |
| 19 min | 121 | 206 |
| 20 min | 124 | 210 |
| 21 min | 127 | 210 |
| 22 min | 129 | 210 |
| 23 min | 133 | 210 |
| 24 min | 135 | 210 |
| 25 min | 138 | 210 |
| 26 min | 141 | 210 |
| 27 min | 144 | 210 |
| 28 min | 147 | 210 |
| 29 min | 150 | 210 |
| 30 min | 152 | 210 |

FIG. 17a continued

Convection Test
Dry Poly w/ Reflective Shield

Convection Test
Hydrated Poly w/ Reflective Shield

Convection Test
U.S. Forestry Fire Shelter

Hydrated Poly w/ Reflective Shield

Hydrated Poly w/ no Reflective Shield

Open Flame Test
Hydrated Polyacrylate

Open Flame Test
U.S. Forestry Fire Shelter

Endothermic w/ Reflective Shield

Endothermic w/ no Reflective Shield

Thermal Conductivity Hydrated w/ Reflective Shield w/ No Air Gap

FIRE AND SMOKE COMPOSITIONS AND THE PROCESSES OF MAKING THEM

CROSS-REFERENCE TO RELATED APPLICATIONS

This application is a division and claims the benefit of U.S. Non-Provisional application Ser. No. 15/245,001, filed Aug. 23, 2016 now U.S. Pat. No. 9,717,938, which is a division and claims the benefit of Ser. No. 14/799,500, filed Jul. 14, 2015 now U.S. Pat No. 9,446,271 which claims the benefit of U.S. Provisional Application No. 62/024,318, filed Jul. 14, 2014, which are hereby incorporated by reference, to the extent that they are not conflicting with the present application.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The invention relates generally to firefighting products and methods and more particularly to fire and smoke prevention compositions and the processes of making them.

2. Description of the Related Art

In United States, a home fire occurs every 85 seconds. On average, and depending on the area and department, the fire department takes about 3-5 minutes to respond to a fire. In 2012, a total of 2,405 lives were lost in and a total of 13,175 injuries reported from residential fires. An estimated 50%-80% of fire deaths are from smoke inhalation. Too much smoke inhalation puts too much carbon monoxide into the lungs and could possibly cause brain damage because the carbon monoxide prohibits red blood cells from transferring oxygen into your body and carbon dioxide out of your body. On average, it would take 15 minutes of straight smoke, with no oxygen, to kill someone and 5-10 minutes to cause permanent brain damage. In addition, some people experience long term lung problems following smoke inhalation.

Oftentimes, the deaths and injuries occur because people are trapped in a bedroom or other rooms of the house, and flames and/or smoke are/is penetrating into the room through door gaps (i.e., the gaps between the door and the floor of the room, hereinafter "door gap" or "floor gap," and between the door and its frame, also known as door jambs, hereinafter "door gap" or "door jamb gap"), exposing the trapped people to smoke and/or flames before firefighters can save them.

Thus, there is a need for a product that can be easily and safely (e.g., non-toxic) applied by people in the door gaps, and that is effective in preventing smoke and/or flames from entering the room, for a sufficient amount of time, such that trapped people can be saved before they incur injuries or death.

Fire shelters can be a means of protection for firefighters when trapped by fires. The best fire shelters need a combination of three elements to address the three types of heat: radiant, convective, and conductive heat. The first element can be a reflective barrier, which can repel exposed flame, but cannot stop convection. The second element should address this, and it is known in the prior art to use an air pocket polyacrylate insulation barrier in a fire shelter. However, even with effective radiant and convective heat barriers, conductive heat is still a problem due to the direct contact between the reflective and insulation barriers, and due to this fire shelters can fail. Therefore, there is a need for a product that can address all three types of heat in a fire shelter.

FIGS. 1*a-c b* show prior art, the New Generation Fire Shelter 101 used by the U.S. Forestry (U.S.F.), with an aluminum foil outer shell with a silica weave bound by an adhesive glue. Firefighters may carry a fire shelter 101 on their backs in a pack 102 as a last line of defense. The weak point is the adhesive having a low melting point relative to the other components, of 500 degrees Fahrenheit. The adhesive can melt and cause the foil to "bubble" away from the silica weave underneath, as shown by a fire shelter after used in a fire 101-*a*, removing the reflective ability of the fire shelter. The aluminum foil used in the U.S. Forestry fire shelter also failed in some cases due to the 1400 degrees Fahrenheit melting point of the foil. Although most forest fires have a temperature of 800 degrees Fahrenheit, the temperature at which wood is combustible, once wind is introduced, a furnace effect can occur and the temperature is greatly increased. Peak heat can surpass 1400 degrees Fahrenheit. Due to the glue melting at 500 degrees and the duration of their entrapment, some firefighters have died in wildland fires. Even in the cases where the fire shelters are successful, some firefighters still received second- and third-degree burns from touching the fire shelter wall, due to the convection heat that passes through the framework and stitching and into the wall creating radiant heat inside of the shelter. Therefore, there is a need for a fire shelter that can withstand higher temperatures and create a safer environment on the inside.

Absorbing polymers may be considered for use in insulating barriers to protect from fire. Sodium polyacrylate ($C_3H_3NaO_2$) is an example of a super-absorbing polymer. It is a cross-linked (network) polymer that contains sodium atoms, and it absorbs water through osmosis. As water is being absorbed by the polymer, sodium molecules are extracted and collected around the hydrated polymer cell. Because of salt's strong ionic bonds, they are ideal at forming an insulation barrier around the hydrated polymer cells, keeping them from melting or evaporating at a heat that would normally do so.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an embodiment, a nontoxic, flame and smoke resistant composition, combining a polymer and water to obtain a gelatinous substance that is easy to use and have a long shelf life, is provided. An advantage of the composition is that, when placed in gaps between a door and door jambs and between a door and the floor, it stops fire and smoke from penetrating a room, and thus, it potentially saves lives.

In another embodiment, color is added to the composition to make it more easily detectable by firefighters and easier to find trapped people behind doors that were sealed with the composition.

In another embodiment, a flow agent is added to the composition so that it can be sprayed onto a fire, to extinguish it.

In another embodiment, the composition may be incorporated into a material to be used as a fire shelter or blanket, as examples. Thus an advantage is protection from fire with a combination of a radiant and convection barriers.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which:

FIGS. 1*a-c b* show prior art, the New Generation Fire Shelter 101 used by the U.S. Forestry.

FIG. 7 shows Table 1 summarizing the results and observations of smoke and fire tests conducted for various other mixtures.

FIG. 8 shows Table 2, listing the time in seconds that it took for fire or smoke to penetrate to the other side of the door within a 10 minute time frame of the smoke and fire experiments.

FIG. 12*a* shows Table 3 summarizing the results of the convection tests using the hydrated polyacrylate, dry polyacrylate, and U.S. Forestry fire shelters.

FIGS. 14*a-b* show a propane torch lit and the flame held towards a U.S. Forestry fire shelter and a hydrated polyacrylate fire shelter, respectively.

FIG. 15*a* shows Table 5 summarizing the results of the experiments testing open flame radiation on a hydrated polyacrylate fire shelter and a U.S. Forestry fire shelter.

FIG. 16*a* shows a raw egg in a Corningware bowl completely submerged in tap water, with a thermometer probe also placed in the water.

FIG. 16*b* shows the egg, bowl, and thermometer probe of FIG. 16*a* wrapped in aluminum foil.

FIG. 17*a* shows Table 6 summarizing the results of the experiments testing the endothermic response of water with and without a reflective shield.

DETAILED DESCRIPTION OF THE PREFERRED EMBODIMENTS

Figure 2:
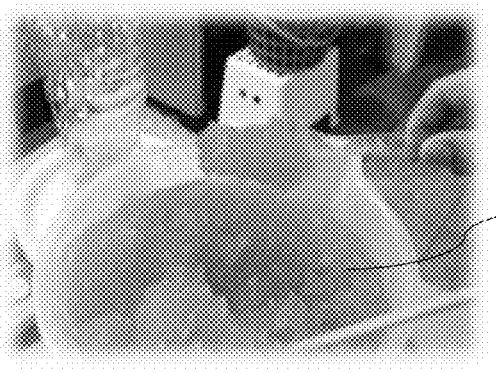
FIG. 2 shows a colored gel embodiment of a polyacrylate composition.

What follows is a detailed description of the preferred embodiments of the invention in which the invention may be practiced. The specific preferred embodiments of the invention, which will be described herein, are presented for exemplification purposes, and not for limitation purposes. It should be understood that structural and/or logical modifications could be made by someone of ordinary skills in the art without departing from the scope and essence of the invention.

In an embodiment, a fire and smoke prevention composition is disclosed. The composition includes sodium polyacrylate ($C_3H_3NaO_2$), distilled water and a color agent (e.g., food red dye #5 and/or yellow dye #5).

The sodium polyacrylate compound is known to be an excellent water absorbent. The United States Department of Agriculture (USDA) has developed sodium polyacrylate in the 1960s as a water absorbent for agriculture. With its ability to store water at up to 400 times its weight, this property made it very effective in low rainfall areas. Sodium polyacrylate, which may be best known as superabsorbent polymer (SAP), has several other uses, including the manufacturing of diapers and adult hygiene products.

Distilled water is a well-known substance. Distilled water is better than tap water for use with the composition because, as it will be explained later, when describing the experiments conducted, with distilled water the composition does not break down.

The color agent may be for example a food red dye, a food yellow dye, or even better, a mixture of red and yellow (e.g., 50% red and 50% yellow) dye, so that the fire and smoke prevention composition has a dark orange color. When the composition has a dark orange color, a flashlight pointed on it appears to cause the reflection of an easy-to-spot, neon-like light. This may help firefighters more easily locate trapped persons behind doors, the gaps 306 of which were treated with the composition. It should be noted that the fire and smoke prevention composition would work well (i.e., sealing the door gaps 306) without the color agent. However, the adding color to the composition makes the composition even more beneficial as explained above.

The resulting composition (i.e., sodium polyacrylate plus distilled water, with or without the color agent) is a gelatinlike substance that is effective (e.g., will not run) at sealing door gaps in order to prevent smoke and fire from entering the room, suppress the fire, and to obtain other beneficial outcomes, as described herein. To apply the gelatinous composition, a ⅜" (three eighths of an inch) for example nozzle (on a squeezable bottle for example) may be used, which is optimum for most door gaps.

To make the fire and smoke prevention composition without the color or flow agents, the following process may be followed. First, preferably 2 (two) grams of sodium polyacrylate is added to preferably 400 (four hundred) grams of distilled water of 70-80 degrees Fahrenheit. The mixture is then stirred with for example a whisk, until the mixture becomes a gel. It may take for example 5-6 seconds of stirring to obtain the gel through manual stirring. Next, the gel is allowed to dehydrate, preferably at room temperature (70-80 degrees Fahrenheit) and preferably for 4 (four) days. Next, the evaporated distilled water is replaced. Next, the gel may be placed into a container (e.g., a plastic bottle) with a spout or nozzle ready for use.

FIG. 2 shows a colored gel embodiment 203 of the polyacrylate composition. To make the same fire and smoke prevention gel as described above but colored, preferably 1.5 (one and a half) grams of color agent (e.g., 50% red food dye and 50% yellow food dye) is added first to the distilled water, and the mixture is stirred to mix before adding the sodium polyacrylate. During experimentation, the product was easy to fill into the water bottle with the use of a funnel and chopstick. Once the bottle was filled, it flowed out of the nozzle with a moderate squeeze.

In an alternative embodiment, a flow agent, such as magnesium stearate, may be added. By adding this component to the fire and smoke prevention composition, the composition becomes a somehow heavy viscous liquid, and thus, it has the ability to flow better through pipes, hoses, nozzles (e.g., a medium spray nozzle) and the like. As such, the composition may be used as superior replacement of often toxic and/or hard to clean halon-type compositions, to suppress and extinguish fires, through a similar application (e.g., spraying it on the fire through a medium spray nozzle). Also, in this liquid form, the composition may be easier used to cool, for example, hot metal parts, such as parts subjected to welding.

To make the viscous fire and smoke prevention composition, preferably 100 (one hundred) milligrams of magnesium stearate powder is added first to the distilled water, and the mixture is stirred to mix before adding the sodium polyacrylate. The dehydration and water replacement steps are the same.

To make the viscous fire and smoke prevention composition colored, preferably the 1.5 (one and a half) grams of color agent (e.g., 50% red food dye and 50% yellow food dye) and the 100 (one hundred) milligrams of magnesium stearate powder are both added first to the distilled water, and the mixture is stirred to mix before adding the sodium polyacrylate. The dehydration and water replacement steps are the same.

What follows is a succinct presentation of the experiments conducted to arrive at the compositions and processes disclosed above.

Sodium polyacrylate from a diaper was first mixed and stirred with tap water to form a gel, which was found to be fire resistant.

Next, 10 grams of sodium polyacrylate was extracted from diapers and tests were conducted to find the proper balance of water to sodium polyacrylate to use a fire barrier. It was noticed that all of the mixes started to break down (water separated from gel).

Next, distilled water was used instead of tap water. It was discovered that more distilled water was needed to achieve the same desired composition consistency, than tap water. It was observed that the distilled water mixture was stable, with no visible breakdown.

Next, testing of composition's sealing and fire suppression properties were conducted by using 1/10 scale doors 304. It was found that the composition was highly fire resistant. However, when deployed into door gaps 306 (on top, sides, and bottom of the door between door, door jambs and floor) small amounts of air pockets formed allowing fire and smoke to penetrate.

Next, different minerals were added to the composition to see if a more gelatinous consistency can be reached. It was found that the composition was highly sensitive to all acids causing immediate breakdowns.

A control batch of the gelatinous composition (distilled water plus sodium polyacrylate mixed as described earlier) was left uncovered for four days causing partial dehydration. Distilled water was then added to compensate for lost water. The composition quickly hydrated, but with no significant air pockets. Testing began again, and the seal around the door, door jambs and floor gap was airtight. No smoke or fire penetrated the gel seal.

Next, a dye was added to help first responders locate trapped victims. Orange was chosen based on its reflective value in the presence of a flashlight.

Next, testing began on the composition to see any limitations that can be foreseen in real life scenarios. The composition was found to be airtight and able to smother a fire in an enclosed room. When a fire in a room with no other substantial access to oxygen (air) other than the doorway, the gel can be deployed around the gaps 306 between the door 305 and door jambs 307 and between the door 305 and floor 307-*a* to seal the fire in the room; in other words, to contain the fire in that room. The seal will keep oxygen (air) from entering the room and the result will be the smothering of the fire from lack of oxygen.

Next, while testing a control burn of an untreated door 304, the composition was used as a fire extinguisher. The results were that less quantity of the composition was needed to extinguish the same amount of fire than water would be needed.

Additional tests and experiments conducted are presented below.

Since it was believed that water is what was keeping the polymer cool to the touch, another experiment was conducted to see if the heat absorption is the same for water as for the mixture/composition (distilled water plus sodium polyacrylate mixed as described earlier). This experiment would eventually show the evaporation rate of water as well as of the composition.

The evaporation test was conducted on both, the composition, then on plain water. The water test was the control. 100 grams of composition was put in a pie pan. 100 grams of water was put in another, same type of pie pan. The heat source was a propane torch held 3 inches away from both items (water and composition). The experiment was to last 20 minutes.

The heat of the pan was to be measured by a digital laser thermometer set in Fahrenheit degrees. The measuring point was the edge of the pie pan.

The results are as follows. In the pie pan with water, the water was completely evaporated after 8 minutes and 34 seconds. The heat of the pan never passed 150 degrees until the 4 minute mark, and then it went up to 223 degrees; by then the water was fully evaporated.

In the pie pan with the gel composition, after 20 (twenty) minutes, the remaining, dehydrated composition weighed only 17 grams. The composition never burned or melted even though at the point it was only 17 grams. The pie pan never passed the 120 degrees mark even after twenty minutes.

The results actually raised the question whether or not the dehydrated composition (after losing the water in this manner) can re-hydrate. 83 grams of distilled water was added to the dehydrated composition in the pan. The dehydrated composition did not reabsorb the water. This finding appears to disprove previous findings that the composition without water would not be affected by direct flame. It turns out that, under certain conditions, it may, by losing the ability to absorb water. The ability of the composition to re-hydrate after a prolonged exposure to fire may be affected. Meaning that the flame, after a prolonged exposure, may break down the sodium polyacrylate. Previous findings showed that, in short flame exposure (10 minutes) or prolonged low level heat exposure (under 550 F for 20 min) the composition will re-hydrate.

The gel composition 203 was tested as a fire repellent several times and it performed equally the same every time. It never, during the 10 minutes test, let any smoke or fire to penetrate the door gaps.

Figure 3A:
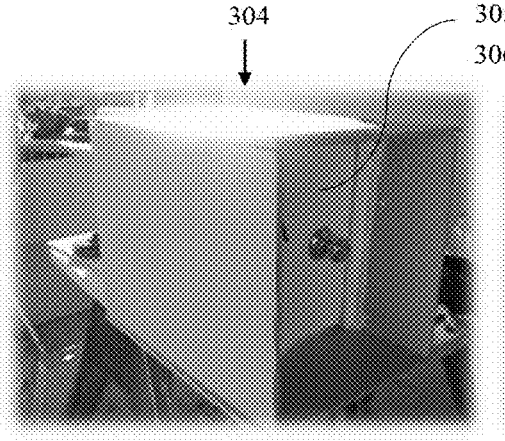
FIGS. 3*a-b* show a side perspective view and a front perspective view, respectively, of a 1/10 scale door and frame built to simulate a room door.
Figure 3B:
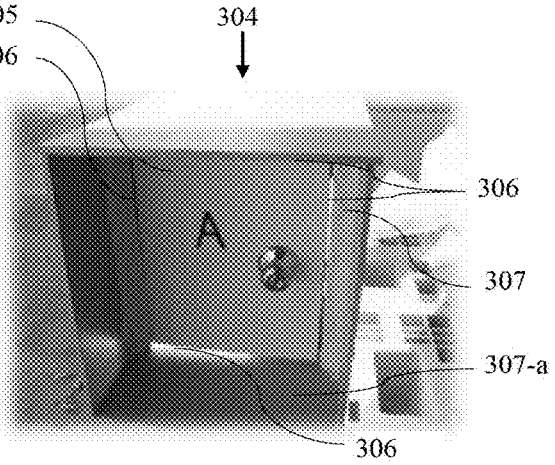

FIGS. 3*a-b* show a side perspective view and a front perspective view, respectively, of a 1/10(one tenth) scale door and frame unit 304 built and used to simulate an actual room door to conduct the experiments described herein. The scale door and frame 304 was used to test how fast the fire would pass through the door gaps 306 and set fire to the opposite side of the door 305 if no fire and smoke prevention gel composition was used to seal the door gaps 306 (between door 304, door jambs 307 and floor 307-*a*). The results were as follows.

The propane torch flame immediately passed through the door 305 and fully ignited the door 305 on both sides after 2 minutes and 18 seconds. Even though the door 305 had a fire rating of twenty minutes, it did not protect the corners of the door 305 from igniting. The door corner was fully engulfed in fire and the fire was beginning to spread. This was a control test to see how a standard interior door would perform in the same test conditions without the composition. The fire and smoke immediately (within 5 seconds) came through the door gaps 306 and jambs 307. The fire that penetrated the door 305 caught the edges and corners of the door 305 on fire within three minutes. After five minutes the fire fully engulfed the 1/10 scale door 304. The door frame (jambs) 307 was also fully engulfed in flames.

Again, after 5 minutes, the 1/10 scale door 304 was fully engulfed in flames. The door 305 temperature was at that time 820 degrees Fahrenheit, and the fire was having large growing flames. The fire extinguishment ability of the gel composition 203 was then tested. About 4 ounces (oz) of the composition 203 that was used as a door sealant (non-magnesium) was thrown at the door. The temperature of the door 305 went from 820 F to 210 F within 5 seconds and it lowered it to 120 F after 2 minutes later, with no further composition added. Additionally, when the test was done with the magnesium composition the results were the same as with the non-magnesium composition.

Thus, the conclusion was that the composition 203 would be equally effective at putting out a fire that already had passed under a door or through door gaps 306, and thus, at stopping any further advance of the fire into the room.

The gel embodiment 203 of the disclosed composition adhered well to the door jambs 307 on the top and sides of the door 305, penetrating easily into the 1/8 inch door gaps 306, without moving. It did not run down or out. It formed a solid seal without any air gaps. Even though the excess material fell off the door jamb 307, the material in the gap 306 did not move. The bottom door gap 306 filled easily and held its shape up to 2 inches high without running. While dispersing the product, enough mixture flowed to the other side of the door 304 (about 1 inch out). This had a dual purpose. The spill over provided a type of fire proofing for the outside of the door edge and floor. It prevented the floor from burning near the door. It also served as a signal to first responders that someone was in the room and needed help.

Smoke Test

Using a 1/10 scale door 304 in a box, a smoke test was conducted, as briefly described hereinafter. The door gaps 306 (top, left, right and bottom) were sealed with the gel composition 203 by placing the nozzle of the plastic bottle close to the gaps 306 and squeezing the mixture thereto.

Figure 4:
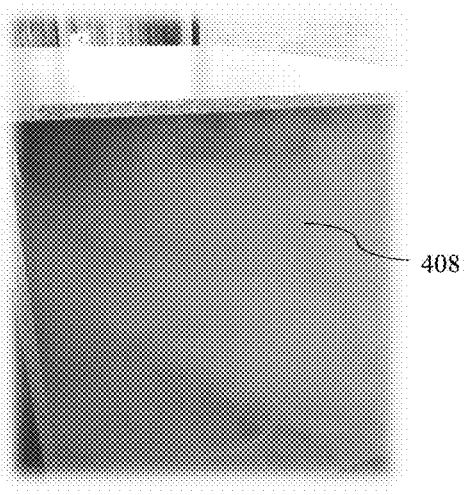
FIG. 4 shows smoke used for a fire test with the scale door of FIGS. 2*a-b*.

FIG. 4 shows smoke 408 used for a fire test with the scale door 304 of FIGS. 3*a-b*. Smoke 408 was created by adding 1 oz. wet shredded newspaper to the six ignited briquettes in a pot. Next, the smoke pot was placed on a pie tin in the side of the box that did not have the mixture squirted on the door gaps 306, to create the smoke as shown in FIG. 4.

Next, the opening of the box was covered with a shield (e.g., wooden sheet), and towels were placed over the covered opening to seal in the smoke 408. A stop watch was started. A smoke alarm that was placed on the side that had the mixture was monitored. The test went on the full 10 minutes. The smoke alarm did not go off as no smoke 408 passed through the sealed door gaps 306.

Fire Test

For the fire test a 1/10 scale door 304 as shown in FIG. 3*a-b* in a box was used as well. The door gaps 306 again (top, left, right and bottom) were sealed with the gel composition 203 by placing the nozzle of the plastic bottle close to the gaps and squeezing the mixture thereto.

Figure 5:
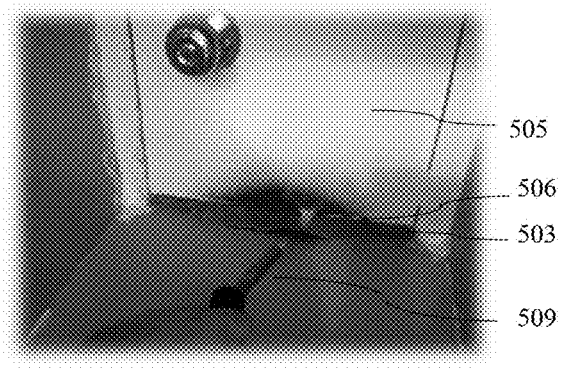
FIG. 5 shows a propane torch held 3 to 4 inches from the bottom of the door and floor gap of the scale door of FIGS. 2*a-b*.

FIG. 5 shows a propane torch flame 509 held 3 to 4 inches from the bottom of the door 505 and floor gap 506 of the scale door of FIGS. 3*a-b*. Simultaneously, a stop watch and a propane torch were started, the propane torch being held 3 to 4 inches away from bottom of the door 505 and floor gap 506.

At 30 second intervals, the temperature of the gel composition 503 was taken with a laser digital thermometer by aiming the laser at the opposite location of where the fire was being dispensed from.

Temperature readings were also taken of the part of the door that was closest to the mixture, but not covered by it, to see how hot door was. This was done to demonstrate that the heat from fire (propane torch) was intense.

When door 505 started to ignite, the focus of the torch flame 509 was moved slightly to the right, and temperature readings continued to be taken.

This process was continued for 10 minutes.

Figure 6:
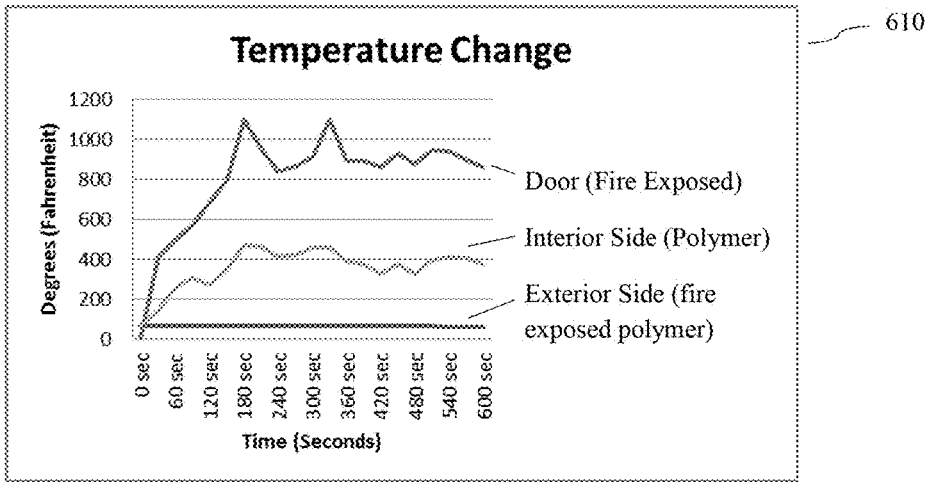
FIG. 6 is a line graph showing the change in temperature in degrees Fahrenheit over the course of the ten minutes, in seconds, of various parts of the scale door of FIGS. 3*a-b*.

FIG. 6 is a line graph 610 showing the change in temperature in degrees Fahrenheit over the course of the ten minutes, in seconds, of various parts of the scale door 504 of FIGS. 3*a-b*. It was observed that the gel composition 503 did not burn. There was only a slight singe. Although the outside door 504 caught on fire, the composition 503 did not melt nor was there any visible change in its consistency. At any time during the 10 minutes period, including when the torch flame 509 was directly aimed at the door gaps 506 one inch away, no flames penetrated the door gap nor did the product in the gap 506 allow any flame to pass to the other side of the door 505. When temperature of the door 505 reached 1100 degrees (outside door, where the flame/fire was) and the outside excess gel composition 503 reached 400 degrees, the interior door 505 reached only 110 degrees and the interior gel 503 did not pass 66 degrees (see FIG. 5), and again, no flame penetrated.

Also, there was no visible evaporation from the gel composition 503 and anything that the gel composition 503 came in contact with did not burn. Even after the 10 minute mark, the interior door 505 showed no signs of fire.

The same smoke and fire tests were also conducted for other mixtures. It should be noted the superiority of the disclosed composition.

FIG. 7 shows Table 1 summarizing the results and observations of smoke and fire tests conducted for various other mixtures.

FIG. 8 shows Table 2, listing the time in seconds that it took for fire or smoke to penetrate to the other side of the door within a 10 minute time frame of the smoke and fire experiments. 600+ seconds indicate that no penetration occurred within 600 seconds (i.e., 10 minutes). Again, it should be noted the superiority of the disclosed composition.

Figure 9:
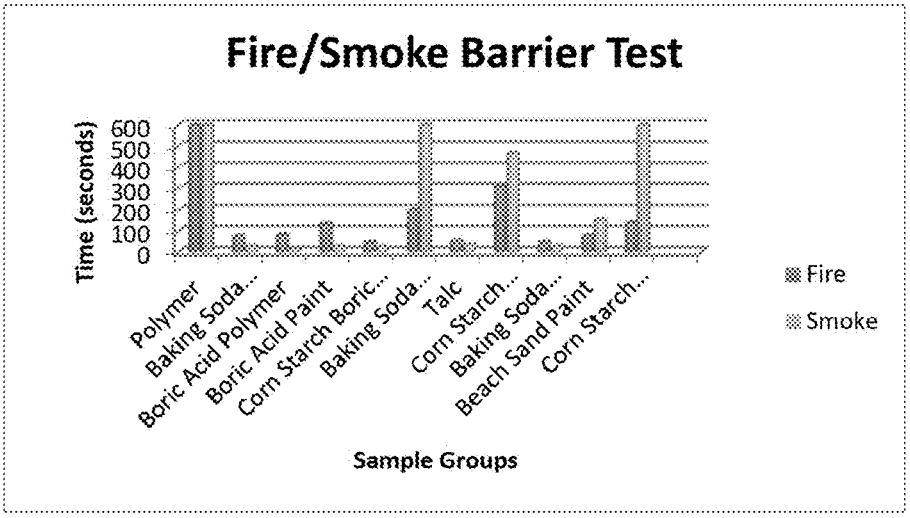
FIG. 9 shows a bar graph depicting the data from Table 2 of FIG. 8.

FIG. 9 shows a bar graph 911 depicting the data from Table 2 of FIG. 8. It should be noted the superior performance of the disclosed polymer.

Carpet Experiment

Another experiment was conducted, using carpet because many rooms in a house are carpeted. The purpose was to see if the fire would burn the carpet underneath the door bypassing the gel composition.

Figure 10:
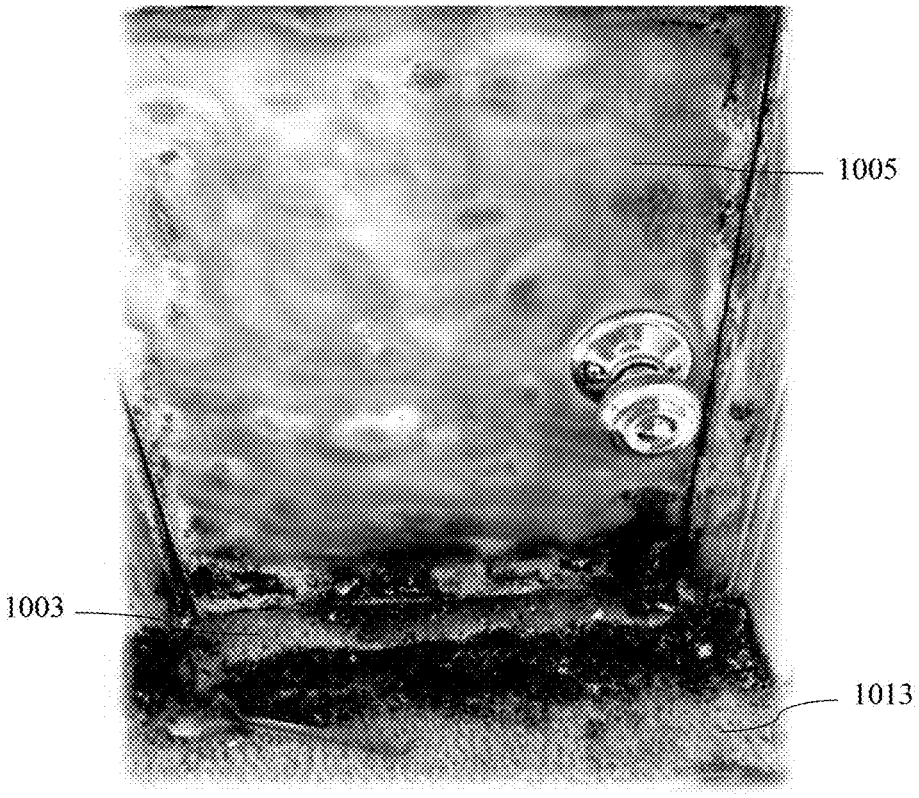
FIG. 10 shows the 1/10 scale door of FIGS. 3*a-b* in a box, with a piece of carpet stapled and glued to the floor of the box.

FIG. 10 shows the 1/10scale door 1005 of FIGS. 3*a-b* in a box, with a piece of carpet 1013 stapled and glued to the floor (i.e., the upper side of the bottom of the box 304 as shown by 307-*a* of FIG. 3) of the box 304. Again, a torch flame 509 and a 1/10 scale door in a box was used as shown in FIGS. 3-4.

Surprisingly, the results were the same as in the fire test described earlier with no carpet 1013. An added benefit of the disclosed gel composition 1003 is that the carpet 1013 that had the gel composition 1003 on it was unchanged. When the gel composition 1003 was removed from the carpet 1013, it left no residue on the carpet 1013. The carpet 1013 that was under the gel composition 1003 was not wet to the touch once the gel 1003 was removed. The carpet 1013 under the gel composition 1003 was protected from the fire by denying oxygen to the advancing fire.

Thus, a nontoxic, flame and smoke resistant mixture 1003 that is easy to use and have a long shelf life was disclosed herein. The disclosed composition, even in the gel form 1003, can be easily squirted out of plastic water bottle for example. It is watery enough to be injected into door gaps 306 and firm enough to keep its shape and not melt when exposed to direct flame from a propane torch 509. It is an effective sealant for smoke and fumes as well. The disclosed composition may be a lifesaving tool by injecting it into door gaps 306, thus, (in the gel form) sealing the door from advancing fire and smoke. When a bright colored dye is added to the mixture, it works as a signal to rescuers that there are people inside the room who need to be saved. When a flow agent is added to the mixture as described earlier, it may be sprayed as a fire extinguisher.

In another exemplary embodiment, a material for a fire shelter, for example, with the fire and smoke prevention composition incorporated therein is provided.

To make a hydrated polyacrylate fire blanket, the following process may be followed. Polyacrylate filling may be wrapped with cheesecloth or any other suitable similar material. The polyacrylate filling may be encased by the cheesecloth or other material by stitching them together with, for example, cotton string, or any other suitable material. The blanket may then be activated by hydration with water by for example pouring water over the blanket or submerging the blanket in water or any other suitable method. Sodium polyacrylate may also be suspended in loose fibers of any suitable material and water soluble glue may be used to make small compartments, such that the sodium polyacrylate crystals are equally distributed throughout the material to be used as a blanket or fire shelter or other fire and smoke prevention device. The blanket or fire shelter or other device may then by activated by hydration with water using any method suitable. The material with sodium polyacrylate crystals may be, for example, carried by any person while the material is unhydrated so as to decrease the overall weight of the object, and then activated by hydration when its use becomes necessary. For example, firefighters may carry dry polyacrylate fire shelters, and if the use of a fire shelter becomes necessary, the firefighters may, for example, use the liquid on their packs to quickly activate the polymer and seek protection inside of the hydrated polyacrylate fire shelter.

What follows is a succinct presentation of the experiments conducted to arrive at the compositions and processes disclosed above.

Figure 11A:
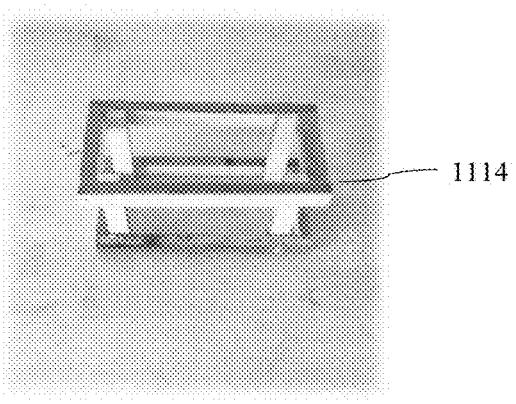
FIGS. 11*a-f* show the steps of making a scale fire shelter using a fire shelter frame, polyacrylate blanket with or without hydration, and using them to conduct a convection test.

FIG. 11*a* shows a fire shelter frame 1114 built using pine wood strips to simulate actual fire shelters 101 in the experiments described herein. Five fire shelter frames 1114 were built. Two 8" wood strips were parallel, 4" apart, and stapled together. Two 4" wood strips were used to connect the 8" strips, forming a rectangle. Another rectangle was made in the same manner, and the two rectangles were connected by stapling four additional wood strips, forming a box 1114.

Figure 11B:
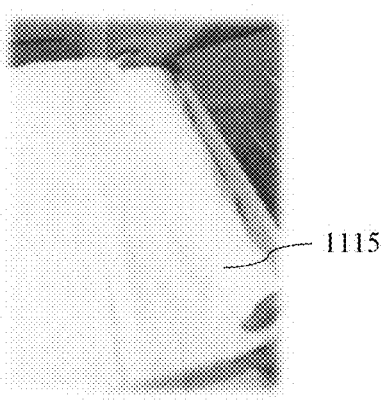

FIG. 11*b* shows an example of a dry polyacrylate blanket 1115 used for the experiments described herein. A 14 inch by 40 inch cheesecloth was used, and polyacrylate filling (not shown, underneath the visible cloth of FIG. 11*b*) was placed on top. The cloth was folded over the polyacrylate filling and stitched to form a 14 inch by 20 inch blanket 1115.

A dry polyacrylate fire shelter with aluminum foil as a reflective shield was used to perform a convection test.

Figure 11C:
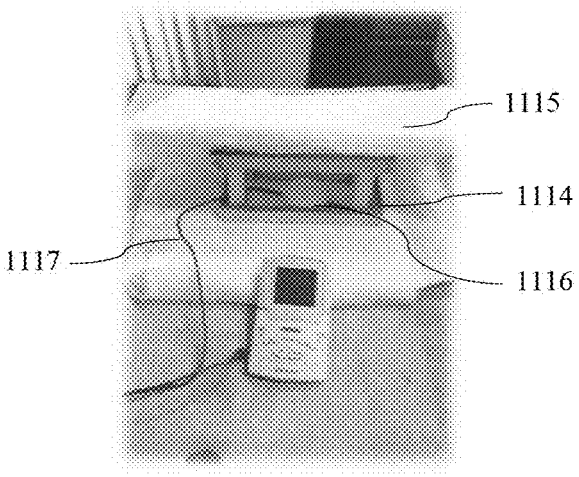

FIG. 11*c* shows the polyacrylate blanket 1115 of FIG. 11*b* wrapped around the fire shelter frame 1114 of FIG. 11*a*. The blanket 1115 was placed lengthwise, and the wood frame 1114 was placed widthwise on top of the blanket 1115. An extra-large room temperature raw egg 1116 was placed in the middle of the frame 1114. A thermometer probe 1117 was placed alongside the egg 1116, making sure that the wire stuck out of the frame 1114.

Figure 11D:
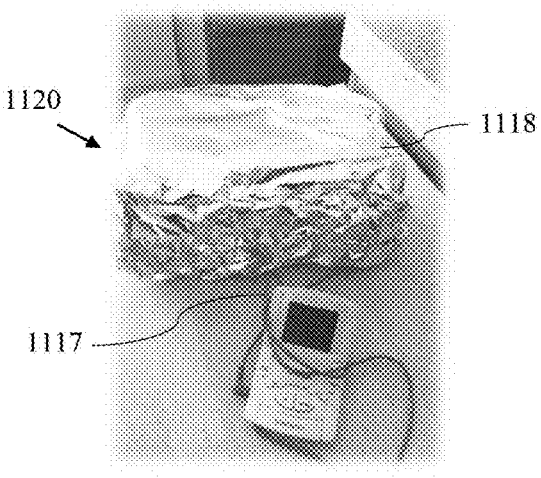

FIG. 11*d* shows the blanket and fire shelter frame of FIG. 11*c* wrapped in aluminum foil 1118 to create a fire shelter 1120, with a thermometer probe 1117 inside of the frame 1114. The foil was placed with its shiny, reflective side down on the table. Next, the frame 1114 wrapped in the blanket 1115 was placed on top, and the foil 1118 was wrapped around the frame 1114 and blanket 1115, with its shiny, reflective side facing outwards, allowing the wire of the thermometer probe 1117 to protrude from the wrapping, creating a dry polyacrylate fire shelter with a reflective shield 1120. The thermometer was programmed with an alarm to read 130 degrees Fahrenheit maximum, to gauge when physical harm might begin to occur to an individual.

The fire shelter 1120 was placed in an oven (not shown), preheated to 550 degrees Fahrenheit. The temperature inside of the fire shelter 1120 was recorded every minute for 30 minutes. At the end of the 30 minutes, the fire shelter 1120 was removed from the oven, and the aluminum foil 1118 and blanket 1115 were unwrapped. A laser thermometer (not shown) was used to verify the reading of the thermometer probe 1117. The egg 1116 was removed from the fire shelter 1120 and placed in a pie tin, and cut in half lengthwise.

Figure 18A:
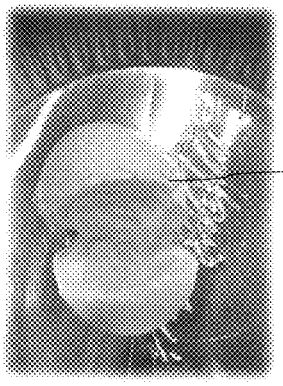
FIGS. 18*a-j* show the status of the eggs used after each experiment.

The starting temperature inside of the fire shelter 1120 was 67 degrees Fahrenheit. The heat transfer occurred immediately. The temperature rose at a very high rate, reaching 136 degrees Fahrenheit in 8 minutes (see FIG. 12*a*). This would be considered deadly in a wildfire. The average rate of increase was ten degrees per minute. At 15 minutes, the smell of burning cloth filled the kitchen where the experiment was taking place. The temperature was 191 degrees, which meant that the heat convection temperature was much higher. After the 30 minutes, the internal temperature was 255 degrees Fahrenheit. Upon removal of the fire shelter 1120 from the oven, it was observed that the framework 1114 had sap leaking out of a knot hole. The laser thermometer reading where the polyacrylate 1115 was touching the foil 1118 was 354 degrees Fahrenheit, the internal polyacrylate 1115 facing the egg 1116 was 288 degrees Fahrenheit, and the egg 1116 when cracked open was 185 degrees Fahrenheit on the inside. The egg 1816-*a* was cooked all the way through (see FIG. 18*a*).

The overall performance of the dry polyacrylate 1115 in the test was observed to be low. The main ingredient of the insulation in the shelter 1120 was the air pockets in the polyacrylate blanket 1115. The foil 1118 wrapped around the blanket 1115 trapped air pockets, giving some protection from the heat. Although the fire shelter 1120 reached 136 degrees Fahrenheit in 8 minutes, it still offered some protection for a short-term situation. The convection heat of an oven will penetrate through aluminum foil 1118 quickly as the foil 1118 absorbs the heat and converts it into radiant heat. The heat then passes through the cloth's 1115 air pockets, passing it to the inner shelter and then converting it back into convection heat. What occurs is the air trapped in the shelter 1120 in the air gap begin to rotate, creating current spreading the hot air in the top and bottom of the shelter. The air gap provides substantial protection, about a 40 degree difference between the interior surface temperature of the shelter and the egg 1116 surface temperature, solely due to the air gap. Since the conduction heat passing through the cloth 1115 is broken up by the air gap, the energy has to then be converted back to convection, and this lowers the overall temperature.

A hydrated polyacrylate fire shelter 1123 with aluminum foil as a reflective shield was used to perform a convection test. A fire shelter frame 1114 as shown in FIG. 11*a* was used, and a polyacrylate blanket as shown in FIG. 11*b* was used. The experimental set up was the same as described above for the dry polyacrylate fire shelter with a reflective shield 1120, with the following additional steps. Before wrapping with foil 1118, the blanket 1115 was wrapped around the fire shelter frame 1114 and then stitched together to prevent it from opening up around the frame, and then placed in a large mixing bowl. Next, water 1119 was poured over it.

Figure 11E:
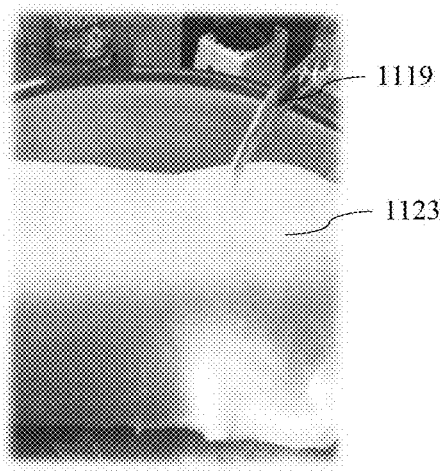

FIG. 11*e* shows a fire shelter frame wrapped with a polyacrylate blanket 1123 being hydrated with tap water 1119 poured over it. 71.1 oz of tap water 1119 was poured over the polyacrylate 1123. Then, after wrapping the fire shelter frame 1114 and blanket 1115 with foil 1118, with its shiny, reflective side facing outwards, the procedure was the same as the previously described experiment. After removing the fire shelter 1120 from the oven, the foil 1118 was unwrapped and the stitching on the blanket 1115 was cut in order to verify the temperature inside of the frame and to remove and cut the egg 1116.

Figure 18B:
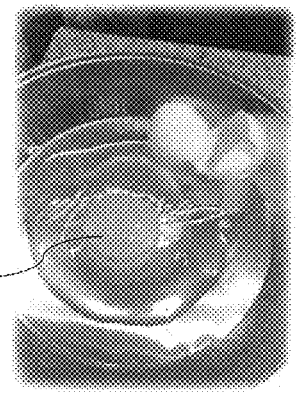

The starting temperature inside the fire shelter 112 was 67 degrees Fahrenheit. There was no change in temperature observed until the fourteenth minute. From there, the temperature rose by one degree every four minutes. At 22 minutes, the rise in temperature became one degree every two minutes. The last four minutes of the experiment, the rise in temperature became one degree every minute. At the end of the 30 minutes, the temperature was 78 degrees Fahrenheit (see FIG. 12*a*). Unlike the dry polyacrylate experiment, there was no noticeable odor. After removal of the fire shelter 1120 from the oven, the outside temperature of the polyacrylate 1115 touching the foil 1118 was 146 degrees, the temperature of the polyacrylate 1115 facing the framework 1114 was 90 degrees, and the outside of the egg 1116 was 78 degrees. The internal temperature of the egg 1116 was 77 degrees. When cracked open, the egg 1816-*b* was observed to be raw (see FIG. 18*b*).

The observed slow rise in temperature in this experiment was due to the Second Law of Thermodynamics, stating that heat will flow from a higher temperature to a lower temperature until equilibrium is reached. Because of the density of the water in sodium polyacrylate's polymer cells, the slow rise in temperature showed that heat takes a much longer time to travel through it. Heat can travel faster through air cells or pockets since air much less dense than water, and less energy may be spent so that more heat can pass through. Another reason for the heat taking longer to pass through the hydrated polymer is that there is a layering effect. Heat must raise the temperature in each individual pocket before passing onto the next pocket through conduction heat. When the polyacrylate polymer 1115 is hydrated 1123, it forms thousands of cells, which form individual layers. The sodium that surrounds the hydrated polymer cells act similarly to a foil wrapping, providing another layer of insulation. Thus, the density of the water 1119 gives insulation properties, the individual cells of water formed by the polymer makes many layers, and the sodium keeps the water 1119 from dehydrating from the polymer.

A U.S. Forestry fire shelter blanket 1121 was used to perform a convection test. The U.S. Forestry fire shelter was cut to form a 14 inch by 20 inch sample blanket, which was wrapped around a fire shelter frame 1114 containing an egg 1116 and thermometer probe 1117 and placed in an oven. The experimental procedure then was the same as the above described experiment with a dry polyacrylate blanket 1115.

Figure 18C:
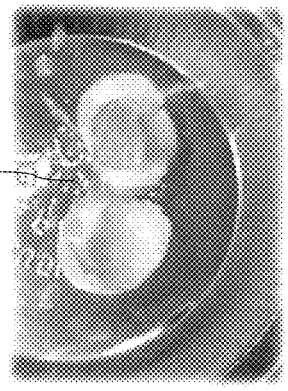
Figure 18D:
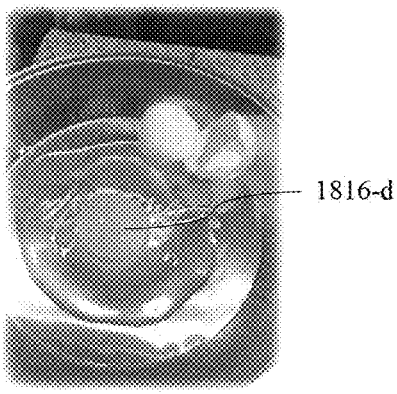

The starting temperature inside of the fire shelter was 67 degrees Fahrenheit. After one minute, it rose to 118 degrees, roughly one degree per second. At one minute and 13 seconds, the internal temperature reached 130 degrees Fahrenheit, the temperature at which physical harm might occur to an individual. The temperature rise remained steady, at a rate of 1 degree for every 2-3 seconds, with no temperature spikes. The smell of burning wood and burning glue filled the kitchen. The maximum temperature of 390 degrees Fahrenheit was reached on the thermometer probe before the 15 minute mark. No more reliable data could be collected, so the experiment was stopped at this point (see FIG. 12*a*). After removal from the oven, the temperature of the egg 1816-*c* was 221 degrees Fahrenheit and fully cooked (see FIG. 18*c*), and the shell was cracked.

The results of the U.S. Forestry fire shelter 1121 convection test showed the importance of having an additional form of insulation. In the oven, the shelter quickly rose to the maximum temperature that the thermometer probe could measure, 390 degrees Fahrenheit, in under 15 minutes, and the experiment had to be stopped prematurely. Upon removal from the oven, it was observed that the shelter 1121 had begun to come apart. The glue which held the two foil sheets and silica weave together had failed, and during the test, the smell of burning glue had been observed.

Figure 11F:
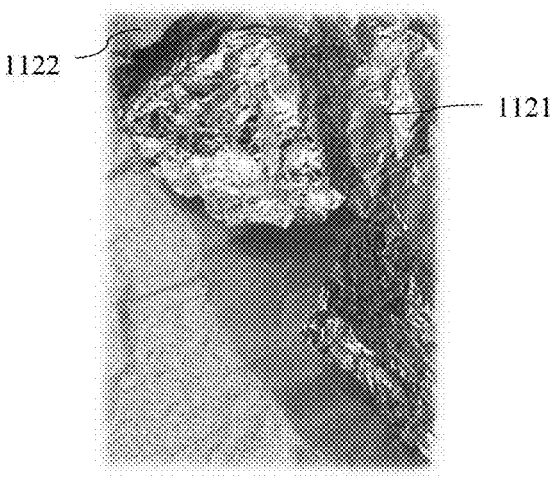

FIG. 11*f* shows that the silica weave 1122 of the U.S. Forestry (U.S.F.) fire shelter 1121 had turned a light brown color, indicating that it had burned. In researching the prior art, it was found that silica weave 1122 can withstand 2400 degrees Fahrenheit before breaking down. Therefore, it was concluded that it was the glue that had failed. The glue of the U.S.F. fire shelter 1121 was known to have failed at 500 degrees Fahrenheit previously, and these test results confirmed this finding. Upon removing the silica weave 1122 from the shelter 1121, it was observed under a magnifying glass that the weave 1122 was transparent and its fibers had open space between them. Previous experiments disclosed herein using the fire and smoke prevention composition showed that the best way to keep fire and smoke from penetrating a door jamb or gap was to fill it with something that has a strong bond with itself (see FIG. 5, FIG. 10). The silica weave 1122 of the U.S.F. fire shelter 1121 depended solely on the foil to complete its air pocket or air cell. As in the previous experiment which relied on air pockets, the heat passed through quickly. The U.S.F. fire shelter performed worse than the dry polyacrylate cloth 1115, which may have been due to the size of the air pockets. The polyacrylate cloth had more air pockets, because it was thicker than the U.S.F. fire shelter 1121 material. Additionally, because the U.S.F. fire shelter 1121 had two sheets of aluminum, the transfer of heat through conduction was much greater, since metal conducts heat better than cloth.

FIG. 12*a* shows Table 3 summarizing the results of the 30 minute convection tests using the hydrated polyacrylate 1123, dry polyacrylate 1115, and U.S. Forestry 1121 fire shelters.

Figure 12B:
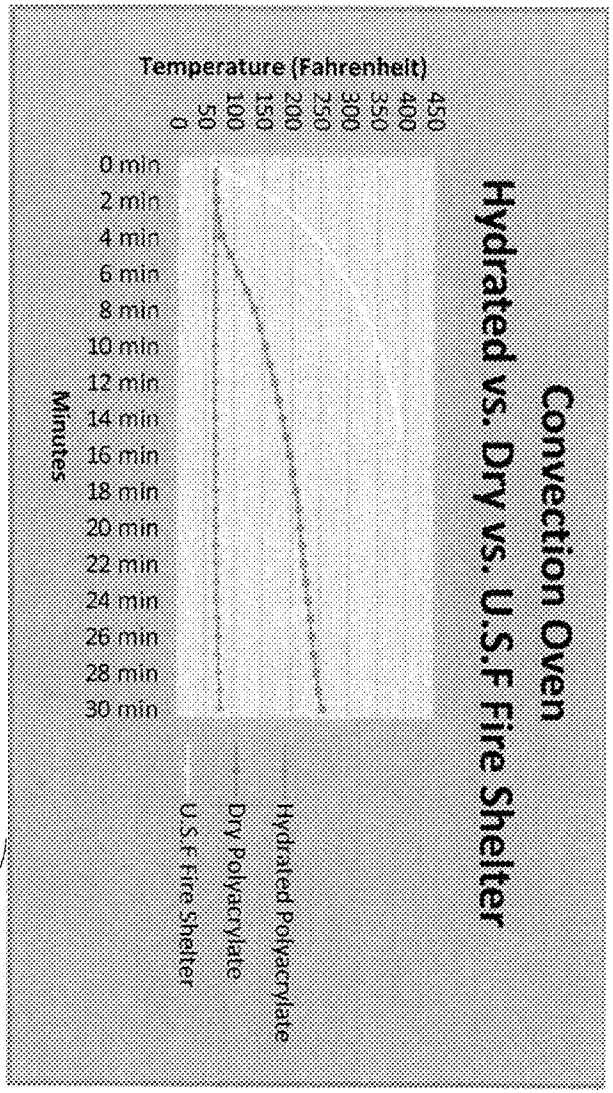
FIG. 12*b* shows a line graph illustrating the results of the convection tests using the hydrated polyacrylate, dry polyacrylate and U.S. Forestry fire shelters.

FIG. 12*b* shows a line graph 1224 illustrating the results of the 30 minute convection tests using the hydrated polyacrylate 1123, dry polyacrylate 1115, and U.S. Forestry 1121 fire shelters. It should be noted the superior performance of the hydrated polyacrylate fire shelter 1123.

To test a hydrated polyacrylate fire shelter with no reflective shield, the experimental procedure was followed for the hydrated polyacrylate fire shelter described above, but without the aluminum foil.

Figure 18E:
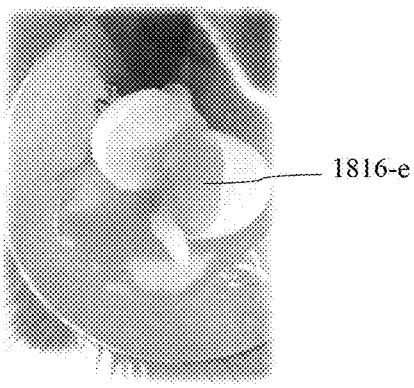

The starting temperature inside the fire shelter was 71 degrees Fahrenheit. Unlike the experiment with a reflective shield, the polyacrylate 1123 had a steady climb in temperature. The temperature rose between 1-2 degrees every minute until it reached 120 degrees Fahrenheit. There were no spikes or plateaus as there were in other experiments. At the end of the experiment, the temperature of the outside of the polyacrylate 1123 was 214 degrees, the temperature of the polacrylate facing the egg was 152 degrees, and the egg was 119 degrees. The egg 1816-*e* was observed to have a soft boiled texture, with mostly uncooked egg whites mixed with some cooked egg whites, and runny yolk (see FIG. 18*e*).

These results showed that the foil or reflective shield does delay the heat transfer. With the foil, the hydrated polacrylate 1123 started to heat up at the 14 minute mark. Without the foil, the heat began rising immediately. It was a slow, steady rise, unlike the experiments using the dry polyacrylate 1115 or the U.S.F. 1121 fire shelters, which showed a steep rise in temperature (see FIG. 12*a*). There was a nearly 50 degree climb in temperature; however, the end result of the experiment still suggested a survivable condition at 120 degrees after 30 minutes. Foil was found to work as a reflective barrier, but not a conduction barrier. It does not retain heat at all once the heat source is removed. The foil 1118 may not be keeping the heat out as much as it is keeping the cool hydrated polymer 1123 from heating up through direct convection heat. Thus, this test shows how the reflective insulator delays the heat by providing another barrier. Since the foil reflects some heat, it also reflects the cooler temperature of the hydrated polymer into itself. Without the foil, the hydrated polymer immediately started its temperature rise. Although at a much slower rate, it still rose steadily, possibly due to the convection heat turning into conduction heat much quicker without the reflective insulation.

Figures 13A, 13B:
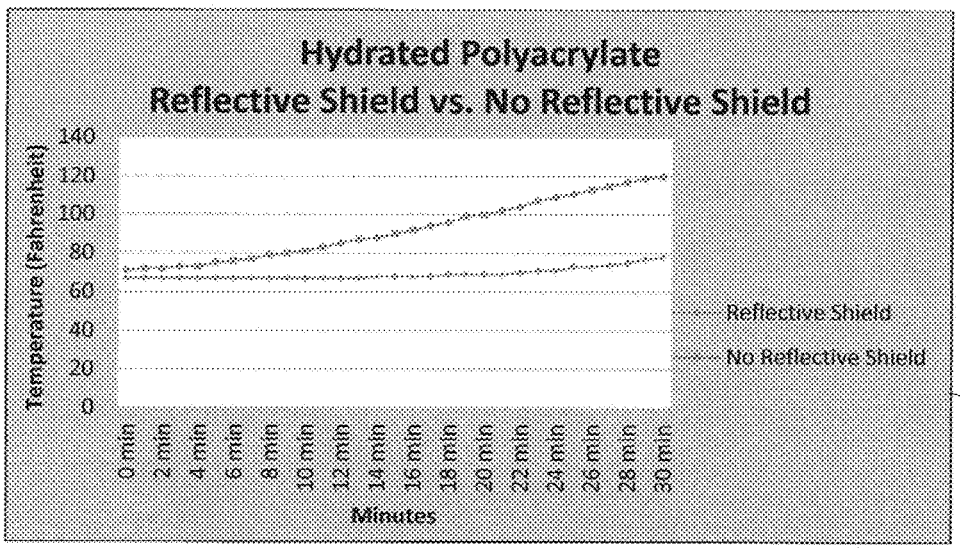
FIG. 13*a* shows Table 4 summarizing the results of the experiments testing the hydrated polyacrylate fire shelter with and without a reflective shield.
FIG. 13*b* shows a line graph illustrating the results of test of the hydrated polyacrylate with and without a reflective shield.

FIG. 13*a* shows Table 4 summarizing the results of the experiments testing the hydrated polyacrylate 1123 fire shelter with and without a reflective shield.

FIG. 13*b* shows a line graph 1325 illustrating the results of the 30 minute test of the hydrated polyacrylate with and without a reflective shield. It should be noted the superior performance of the hydrated polyacrylate with a reflective shield.

To test open flame radiation with a U.S. Forestry fire shelter, a 14 inch by 18 inch sheet was cut from a U.S. Forestry fire shelter to make a sample blanket. One extra-large room temperature raw egg was placed in the middle of the sheet, with a thermometer probe. The fire shelter blanket was wrapped around the egg and probe to make an 11 inch by 4 inch by 3 inch shelter.

FIG. 14*a* shows a U.S. Forestry fire shelter 1426 blanket wrapped around an egg and thermometer probe, with a lit propane torch 1409 applying flame about four inches from the fire shelter 1426. The experiment proceeded for 15 minutes, with temperature readings being recorded every minute. The shelter 1426 was then opened and the egg was cut in half.

Figure 18F:
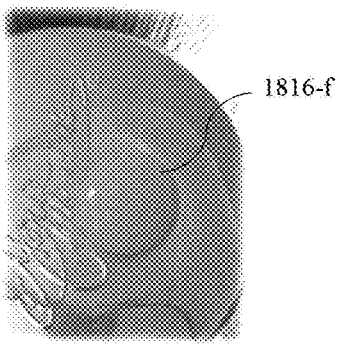
Figure 18G:
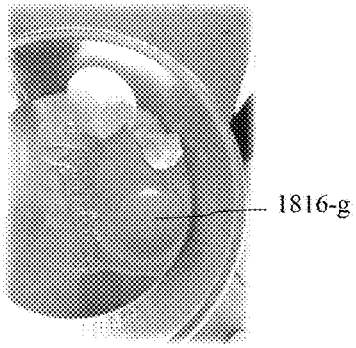

The starting temperature inside of the fire shelter 1426 was 82 degrees Fahrenheit. There was an approximately 1 inch air gap separating the egg from the inner lining of the U.S.F. fire shelter. The foil immediately bubbled and separated exposing the silica weave 1122, which turned a glowing red. After one minute, the temperature reached 123 degrees. After three minutes, it reached 222 degrees, at a steep incline. At four minutes, it reached 236 degrees and it plateaued until the eighth minute, when it rose to 239. By the eleventh minute, it reached 244 degrees and remained there until the end of the 15 minute test. When the wrapping was opened, the egg shell was cracked, with egg white seeping out. The egg shell was 140 degrees and the internal egg temperature was 103 degrees. There was a very slight amount of egg white that was cooked; otherwise, the egg 1816-*g* was raw (see FIG. 18*g*).

The results of this test helped to understand how a U.S.F. fire shelter 1426 would perform under extreme direct heat from a propane torch 1409. The torch flame 1409 can reach a temperature of 2400 degrees Fahrenheit. The shelter 1426 was built into a small scale shelter, but with the same principle of how a firefighter may use it. As the fire was directed onto the foil 1426, the foil 1426 quickly flaked away. This supported the research that was done on the foil, which suggested that foil may only be able to reach 1400 degrees before it melts. After the foil was flaked away, the flame 1409 was directly aimed at the silica weave 1122 from four inches away. The weave 1122 immediately glowed red under the direct flame, and the internal temperature of the wrapping quickly rose to 123 degrees after one minute and continued to rise until 244 degrees was reached after 11 minutes. The temperature remained the same until the end of the 15 minute test. The observation of the exposed silica weave 1122 glowing but not burning led to the suggestion that the flame was under 2400 degrees, which would cause a breakdown of the silica weave at its melting point.

As previously noted, the silica weave 1122 was very loose in its construction, with many air gaps, so that heat transferred easily into the inner shelter. The next observation is why the temperature rise stopped at 244 degrees. It is known that the internal temperature of the U.S.F. fire shelter can reach 200 degrees, which supports the idea that the silica weave has an ability to reflect and insulate very high radiation heat, but not high convection heat.

To test open flame radiation with a hydrated polyacrylate fire shelter, aluminum foil was laid with its shiny, reflective side down, and a polyacrylate blanket was placed on top. 6 oz of water was poured evenly over the blanket. An extra-large room temperature raw egg was placed in the middle of the blanket, alongside a thermometer probe. The blanket and foil were wrapped around the egg and probe, to make an 11 inch by 4 inch by 3 inch fire shelter.

FIG. 14*b* shows a propane torch 1409 lit and the flame held about 4 inches away from a hydrated polyacrylate fire shelter 1427. The experiment proceeded for 15 minutes, with temperature readings being recorded every minute. The shelter 1427 was then opened and the egg was cut in half.

The starting temperature inside of the fire shelter 1427 was 82 degrees Fahrenheit. The foil burned away immediately as in the previous experiment. However, while the hydrated polymer blanket interior did char slightly, no other breakdowns occurred and there were no other visible effects. During the 15 minute test, the temperature inside the shelter 1427 did not rise. These results supported the findings of the convection heat test. When the egg 1816-*f* was removed and cracked open at the end of the experiment, it was observed to be completely raw and still at the same temperature of 82 degrees (see FIG. 18*f*).

These results supported the idea that the hydrated polymer reflects the direct heat from the flame because of the sodium that surrounds the individual cells. Although there was some charring to inidicate that the polymer did break down and burn, it also formed an insulation with that resulting carbon, which may be what stopped the polymer from continuing to break down. Previous experiments had shown that in longer experiments, the polymer may break down.

FIG. 15*a* shows Table 5 summarizing the results of the experiments testing open flame radiation on a hydrated polyacrylate fire shelter and a U.S. Forestry fire shelter.

Figure 15B:
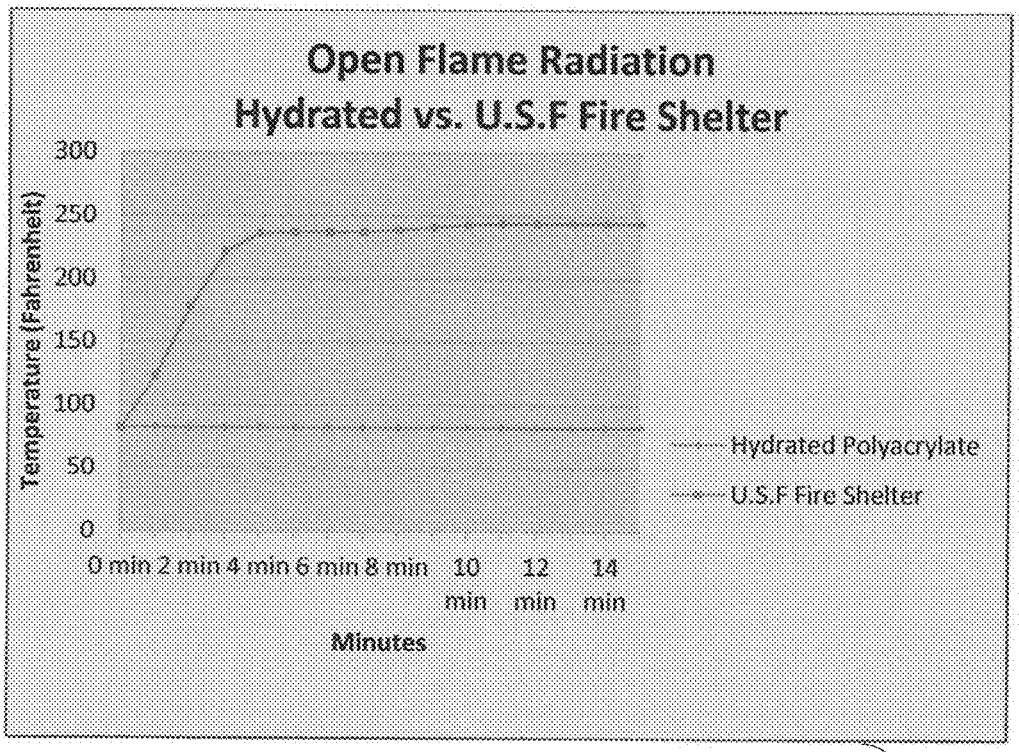
FIG. 15*b* shows a line graph illustrating the results of the open flame radiation tests using a hydrated polyacrylate and U.S.F. fire shelter.

FIG. 15*b* shows a line graph 1528 illustrating the results of the 15 minute open flame radiation tests using a hydrated polyacrylate 1427 and U.S.F. 1426 fire shelter. It should be noted the superior performance of the hydrated polyacrylate fire shelter 1427, which did not allow any change in temperature on the inside.

To test the endothermic response of water with no reflective shield, a raw egg was placed in a Corningware bowl.

FIG. 16*a* shows a raw egg in a Corningware bowl completely submerged in 24 oz of tap water 1619, with a thermometer probe also placed in the water. The starting temperature was recorded. Next, the bowl was placed into an oven. The experiment proceeded for 30 minutes, with temperature readings being recorded every minute. The bowl was then removed from the oven and the egg was cut in half.

Figure 18H:
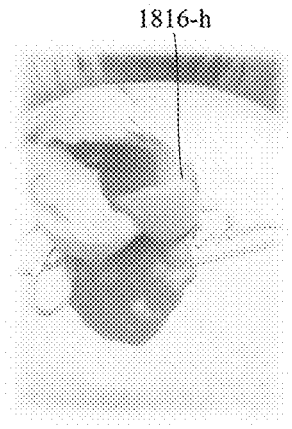
Figure 18I:
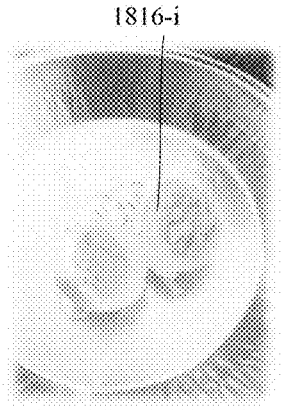

The starting temperature of the egg in water was 73 degrees Fahrenheit. There was an overall steady climb in temperature of 5-8 degrees per minute with no heavy spikes or plateaus. Once the experiment had proceeded for 20 minutes, the temperature reached 210 degrees and the water had a steady boil. This continued until the end of the 30 minutes. Upon removal of the egg 1816-*i*, it was observed that it had been hard-boiled (see FIG. 18*i*).

These results showed that the water without a foil barrier or an air gap had a quick and steady increase in temperature. The boiling point of the water was reached at the 20 minute mark.

To test the endothermic response of water with a reflective shield, a raw egg 1616 was submerged in 24 oz of water 1619 in a Corningware bowl 1629 with a thermometer probe 1617.

FIG. 16*b* shows a bowl 1629 wrapped in aluminum foil 1618 with the shiny, reflective side facing outwards. The starting temperature was recorded. Next, the wrapped bowl 1629 was placed into an oven. The experiment proceeded for 30 minutes, with temperature readings being recorded every minute. The bowl 1629 was then removed from the oven and the egg 1616 was cut in half.

The starting temperature was 73 degrees Fahrenheit. There was a steady climb in temperature during the experiment, generally 2-3 every minute. It reached 152 degrees at the end of the 30 minutes, and did not reach the boiling point of 210 degrees during the test even though the oven temperature had been set to 550 degrees. When the bowl 1629 was removed from the oven and the foil was pulled back, small bubbles of air on the side of the bowl 1629 were observed, although the water had not begun boiling. When the egg 1816-*h* was removed and cut into, its internal temperature was 150 degrees. Parts of the egg were still soft, and overall was mostly cooked (see FIG. 18*h*).

These two endothermic response test results strongly suggested that a reflective shield does form an insulation barrier. The foil shield worked well to reflect some heat and delay the second endothermic law. Additionally, although the foil did act as a shield, it is likely that the air gap that formed in the area between the foil and the water played a greater role in these results. The two tests described herein suggested strongly that having a foil barrier and maintaining an air gap are beneficial in insulation.

FIG. 17*a* shows Table 6 summarizing the results of the experiments testing the endothermic response of water with and without a reflective shield.

Figure 17B:
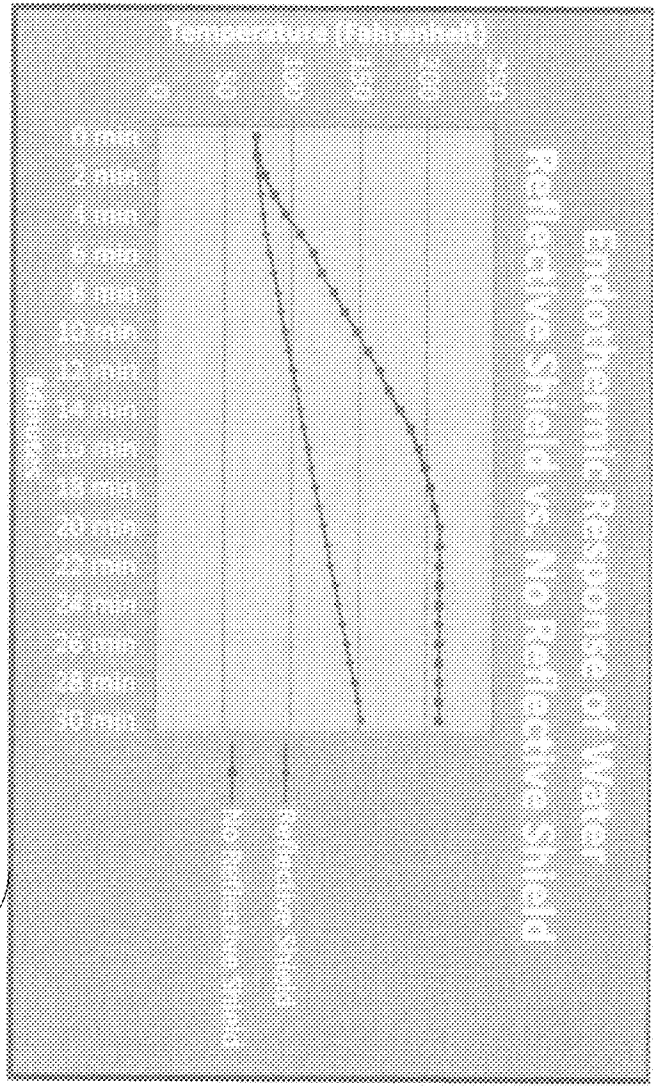
FIG. 17*b* shows a line graph illustrating the results of the experiments testing the endothermic response of water with and without a reflective shield

FIG. 17*b* shows a line graph 1730 illustrating the results of the experiments testing the endothermic response of water with (FIG. 16*a*) and without a reflective shield (FIG. 16*b*). It should be noted the superior performance of the reflective shield (FIG. 16*a*) in maintaining a lower temperature of water 1619.

To test thermal conductivity of a hydrated polyacrylate blanket with a reflective shield and with no air gap, a raw egg and hydrated polyacrylate blanket were used as in previously described experiments, but no fire shelter frame was used. A sheet of 16 inch by 14 inch aluminum foil was laid out and a 3 inch by 12 inch polyacrylate blanket was laid on top of the foil. Room temperature water was poured over the polyacrylate blanket. A raw egg was placed in the middle of the blanket and wrapped with the blanket and foil with the foil's shiny, reflective side facing outwards. This wrapping was placed in an oven for 30 minutes, and then removed and cut in half.

Figure 18J:
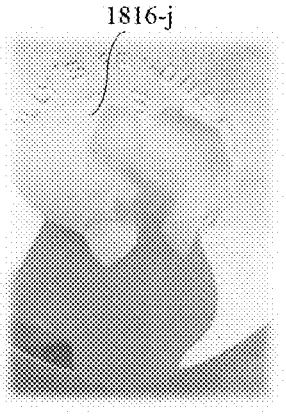

The starting temperature inside of the wrapping was 71 degrees Fahrenheit. After the 30 minutes, the temperature of the outside of the foil was 92 degrees, the temperature of the polyacrylate touching the foil was 175 degrees, and the temperature of the polymer facing the egg was 160 degrees. The egg's temperature was 140 degrees. When the egg 1816-*j* was cracked, it was observed to look like a soft-boiled egg, with some runny egg white and some runny yolk (see FIG. 18*j*). There was observed to be a large amount of heat transference between the foil and the polyacrylate blanket.

These results strongly suggested the importance of an air gap in the fire shelter. There was a nearly 70 degree rise in temperature compared to the test that was performed with an air gap, using the fire shelter frame with blanket wrapped around the frame (see FIG. 12*a*), which rose only 11 degrees. In analyzing the results, it was observed that the air gap works by breaking up the conductive heat, meaning that contact between two objects of different temperatures will follow the Second Law of Thermodynamics. The object of greater temperature will pass heat to that of the lesser temperature. With contact, the heat transfer is very effective. Even though the polymer is an effective insulator, it still passes some conductive heat through the contact of polymer cells, which may be why the insulator passed the heat onto the egg. With an air gap, heat may pass onto the inner shelter no matter what insulator is in place.

FIGS. 18*a-j* show the status of the eggs used after each experiment. It should be noted the superiority of the conditions that resulted in uncooked, raw eggs.

To test the shiny and dull sides of aluminum foil for their insulation value, two potatoes (not shown) of nearly the exact same weight, length, and girth were used. The temperatures of the potatoes were taken and each were wrapped with enough foil to cover the potatoes in one layer of foil. One potato was wrapped with the foil's shiny, reflective side facing outwards, and the other was wrapped with the foil's dull side facing outwards. Both wrapped potatoes were placed in an oven that had been preheated to 400 degrees Fahrenheit. The potatoes were placed in the oven for 30 minutes. The potatoes were then removed and a laser thermometer was used to measure the outside temperature of the aluminum foil of both wrapped potatoes. A thermometer probe was then used to measure the internal temperatures of both potatoes by inserting the probe one inch deep into the potatoes. The experiment was repeated for other sets of exact same weight potatoes.

The starting temperature of the potatoes was 72 degrees Fahrenheit. After the 30 minutes, the potatoes were removed from the oven and their temperatures were measured using a laser thermometer.

Figure 19:
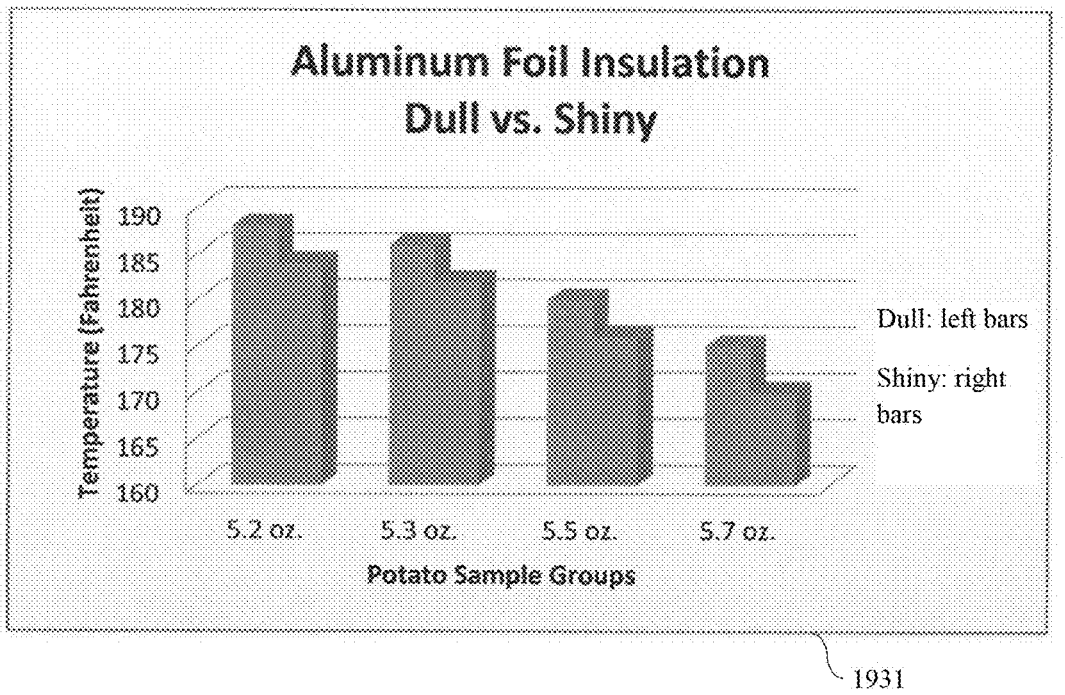
FIG. 19 shows a bar graph illustrating the rests of the aluminum foil shiny and dull side comparison test.

FIG. 19 shows a bar graph 1931 illustrating the rests of the aluminum foil shiny and dull side comparison test. When the test was performed using sets of potatoes having different weights, the temperature of the potato that had the dull side of the foil facing outwards was consistently approximately 5 degrees higher than that of the potato that had the shiny side of the foil facing outwards.

It may be advantageous to set forth definitions of certain words and phrases used in this patent document.

All temperature degrees in this disclosure are Fahrenheit degrees, unless otherwise indicated. All length units are inches, unless otherwise indicated. All eggs were extra-large and raw, and at room temperature at the start of each experiment. All experiments using an oven had the oven preheated to 550 degrees Fahrenheit unless otherwise indicated.

The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein.

What is claimed is:

1. A method for fire and smoke prevention, suppression or extinction using a gelled composition comprising sodium polyacrylate and distilled water with substantially no air pockets within the gelled composition, wherein the ratio of sodium polyacrylate to distilled water in the gelled composition is about 1 to 200 by weight, the method comprising placing the gelled composition in the path of the fire or smoke.

2. The method of claim 1, wherein the path of the fire or smoke comprises all gaps between a door and a floor and between the door and the door's side and top jambs, such that an airtight seal is created therein.

3. The method of claim 2, wherein the gelled composition further comprises a dye, such that the gelled composition is colored, and thus easily spotted by firefighters.

4. The method of claim 1, wherein the gelled composition further comprises a flow agent.

5. The method of claim 4, wherein placing the gelled composition in the path of the fire or smoke comprises spraying the gelled composition onto the fire.

* * * * *